US011732449B2

(12) United States Patent
Wang et al.

(10) Patent No.: US 11,732,449 B2
(45) Date of Patent: Aug. 22, 2023

(54) WATER OUTLET DEVICE

(71) Applicant: Xiamen Lota International Co., Ltd., Fujian (CN)

(72) Inventors: Xuedong Wang, Fujian (CN); Xiaofei Guo, Fujian (CN); Chuanbao Zhu, Fujian (CN)

(73) Assignee: Xiamen Lota International Co., Ltd., Fujian (CN)

( * ) Notice: Subject to any disclaimer, the term of this patent is extended or adjusted under 35 U.S.C. 154(b) by 292 days.

(21) Appl. No.: 17/359,836

(22) Filed: Jun. 28, 2021

(65) Prior Publication Data

US 2022/0275611 A1 Sep. 1, 2022

(30) Foreign Application Priority Data

Feb. 26, 2021 (CN) ..... 202110219903.9

(51) Int. Cl.
*E03C 1/04* (2006.01)

(52) U.S. Cl.
CPC .... *E03C 1/0405* (2013.01); *E03C 2001/0415* (2013.01)

(58) Field of Classification Search
CPC ..... E03C 1/0405; E03C 2001/0415
USPC ..... 4/678
See application file for complete search history.

(56) References Cited

U.S. PATENT DOCUMENTS

2016/0136659 A1* 5/2016 Erickson ..... B05B 1/18 239/443
2017/0173602 A1* 6/2017 Erickson ..... B05B 1/3026
2019/0224694 A1* 7/2019 Wang ..... B05B 1/3013
2021/0198876 A1* 7/2021 Lin ..... B05B 1/18
2022/0243436 A1* 8/2022 Wu ..... E03C 1/0404
2022/0268002 A1* 8/2022 Wu ..... E03C 1/0405
2022/0364341 A1* 11/2022 Zhang ..... E03C 1/08

* cited by examiner

*Primary Examiner* — Huyen D Le
(74) *Attorney, Agent, or Firm* — Cooper Legal Group, LLC

(57) ABSTRACT

The present disclosure discloses a water outlet device comprising an inlet passage, a first outlet passage, a second outlet passage, a third outlet passage, a first valve chamber, a second valve chamber, a first sealing member, a second sealing member, and a first resetting member. When the second sealing member is controlled to move and to be changed from blocking the second outlet passage to blocking the third outlet passage, the first sealing member is correspondingly changed from blocking the second valve chamber to blocking the first outlet passage, and the first sealing member continues blocking the first outlet passage due to water pressure. When the inlet passage is blocked, the first sealing member is biased by the first resetting member to move to block the second valve chamber.

20 Claims, 6 Drawing Sheets

WATER OUTLET DEVICE

RELATED APPLICATIONS

This application claims priority to Chinese patent application number 202110219903.9, filed on Feb. 26, 2021. Chinese patent application number 202110219903.9 is incorporated herein by reference.

FIELD OF THE DISCLOSURE

The present disclosure relates to a water outlet device.

BACKGROUND OF THE DISCLOSURE

A conventional water outlet device with three water outlet functions comprises a housing, a water divided body disposed in the housing, and a water outlet panel disposed on the housing. The water divided body comprises an inlet passage and three outlet passages, and the three outlet passages are respectively in communication with water outlet holes disposed on the water outlet panel. The conventional water outlet device comprises a switching structure similar to a ball-point pen to achieve switching of the three water outlet functions. However, the switching structure cannot be reset to a pre-set, commonly used water outlet function, which makes it inconvenient for users to use. There is also another type of water outlet device that uses two switching structures, and the user needs to control the two switching structures, which is troublesome to operate.

BRIEF SUMMARY OF THE DISCLOSURE

The present disclosure provides a water outlet device to solve the deficiencies in the background. The water outlet device has a resetting function. Each time the water outlet device stops being used, the water outlet device is reset to an initial state in which water flows out of a default outlet passage, and it is only necessary to control a second sealing member to achieve controlling of the water outlet device, which is convenient for users to use.

In order to solve the technical problem, a technical solution of the present disclosure is as follows.

A water outlet device comprises an inlet passage, a first outlet passage, a second outlet passage, a third outlet passage, a first valve chamber, a second valve chamber, a first sealing member, a second sealing member, and a first resetting member. The inlet passage and the first outlet passage are each in communication with the first valve chamber. The second outlet passage and the third outlet passage are each in communication with the second valve chamber. The first valve chamber is in communication with the second valve chamber. The first sealing member is movably disposed in the first valve chamber to be controlled to alternatively block the second valve chamber or the first outlet passage. The second sealing member is movably disposed in the second valve chamber to be controlled to alternatively block the second outlet passage or the third outlet passage. When the second sealing member is controlled to move and to be changed from blocking the second outlet passage to blocking the third outlet passage, the first sealing member is correspondingly changed from blocking the second valve chamber to blocking the first outlet passage, and the first sealing member continues blocking the first outlet passage due to water pressure. When the inlet passage is changed from a water supply state to a water stop state, the first sealing member is biased by the first resetting member to move to block the second valve chamber.

In a preferred embodiment, when the first sealing member is biased by the first resetting member to move to block the second valve chamber, the second sealing member correspondingly blocks the second outlet passage.

In a preferred embodiment, the water outlet device comprises a second resetting member. When the inlet passage is changed from the water supply state to the water stop state, the second sealing member is biased by the second resetting member to block the second outlet passage.

In a preferred embodiment, when the inlet passage is in the water supply state, the second sealing member continues alternatively blocking the second outlet passage or the third outlet passage due to the water pressure.

In a preferred embodiment, the first sealing member is coaxial with second sealing member.

In a preferred embodiment, the water outlet device comprises a water stopping member. The water stopping member is controlled to block the inlet passage.

In a preferred embodiment, the second sealing member comprises a switching valve shaft, and the switching valve shaft is controlled to slide and extend into the first valve chamber to push the first sealing member.

In a preferred embodiment, a sliding shaft hole extends and is connected between the first valve chamber and the second valve chamber. A first end of the switching valve shaft passes through the sliding shaft hole and then extends into the first valve chamber. The second sealing member further comprises a sealing ring, and the sealing ring is sealingly connected between the sliding shaft hole and the switching valve shaft.

In a preferred embodiment, the second sealing member further comprises a second sealing gasket disposed on the switching valve shaft, and the second sealing gasket moves with the switching valve shaft to alternatively block the second outlet passage or the third outlet passage.

In a preferred embodiment, the water outlet device comprises a switching button. The switching button is operatively coupled to the switching valve shaft and configured to drive the switching valve shaft to slide.

Compared with the existing techniques, the technical solution has the following advantages.

1. It is only necessary to control the second sealing member to achieve controlling of the water outlet device and controlling of at least three outlet passages of the water outlet device. In addition, when the inlet passage is blocked, the first sealing member is biased by the first resetting member to move to block the second valve chamber, and the water resets to flow out of the first outlet passage. The water outlet device can be reset each time the water outlet device stops being used.

2. When the first sealing member is biased by the first resetting member to move to block the second valve chamber, the second sealing member correspondingly blocks the second outlet passage. In the case where the second resetting member is not provided, the second sealing member can also be reset to the initial state.

3. When the inlet passage is blocked, the second sealing member is biased by the second resetting member to move to block the second outlet passage. Each time the water outlet device stops being used, the water outlet device is reset to the initial state, and the user operates the second sealing member to switch between the first outlet passage, the second outlet passage, and the third outlet passage, in sequence, each time the user operates the water outlet device. The water outlet device can rely only on the second resetting member to reset the second sealing member, and the water outlet device can also rely on the first sealing member being operatively coupled the second sealing member to achieve the resetting of the second sealing member. The second resetting member has the effect of stabilizing a resetting effect.

4. The second sealing member continues blocking of the second outlet passage or the third outlet passage due to water pressure. When the user operates the second sealing member, the second outlet passage or the third outlet passage can be opened without continuous force on the second sealing member.

5. The water stopping member is controlled to block the inlet passage to enable the water outlet device to be reset to the initial state. When the inlet passage is supplied with water again, the water flows out of the first water outlet port first.

DETAILED DESCRIPTION OF THE EMBODIMENTS

Figure 1:
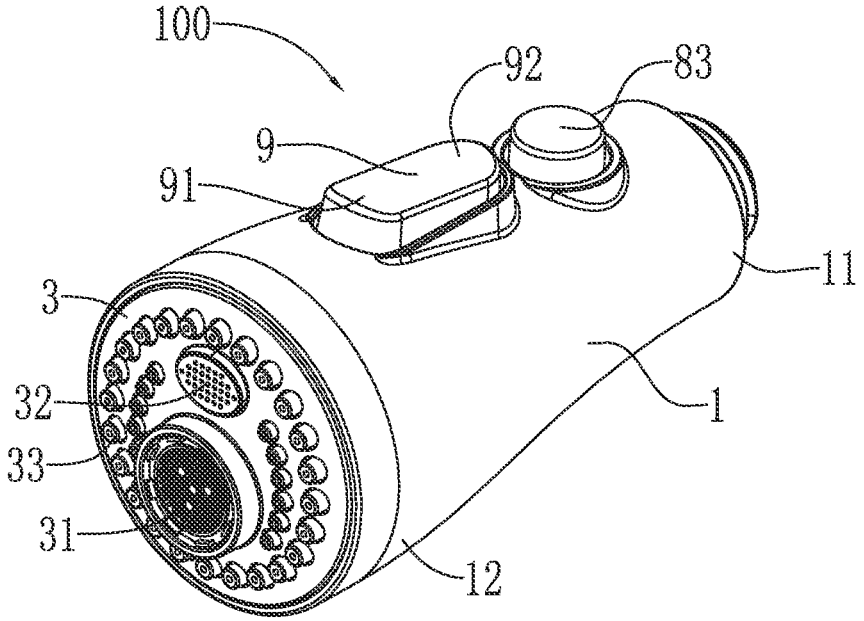
FIG. 1 illustrates a perspective view of a water outlet device in an embodiment.
Figure 2:
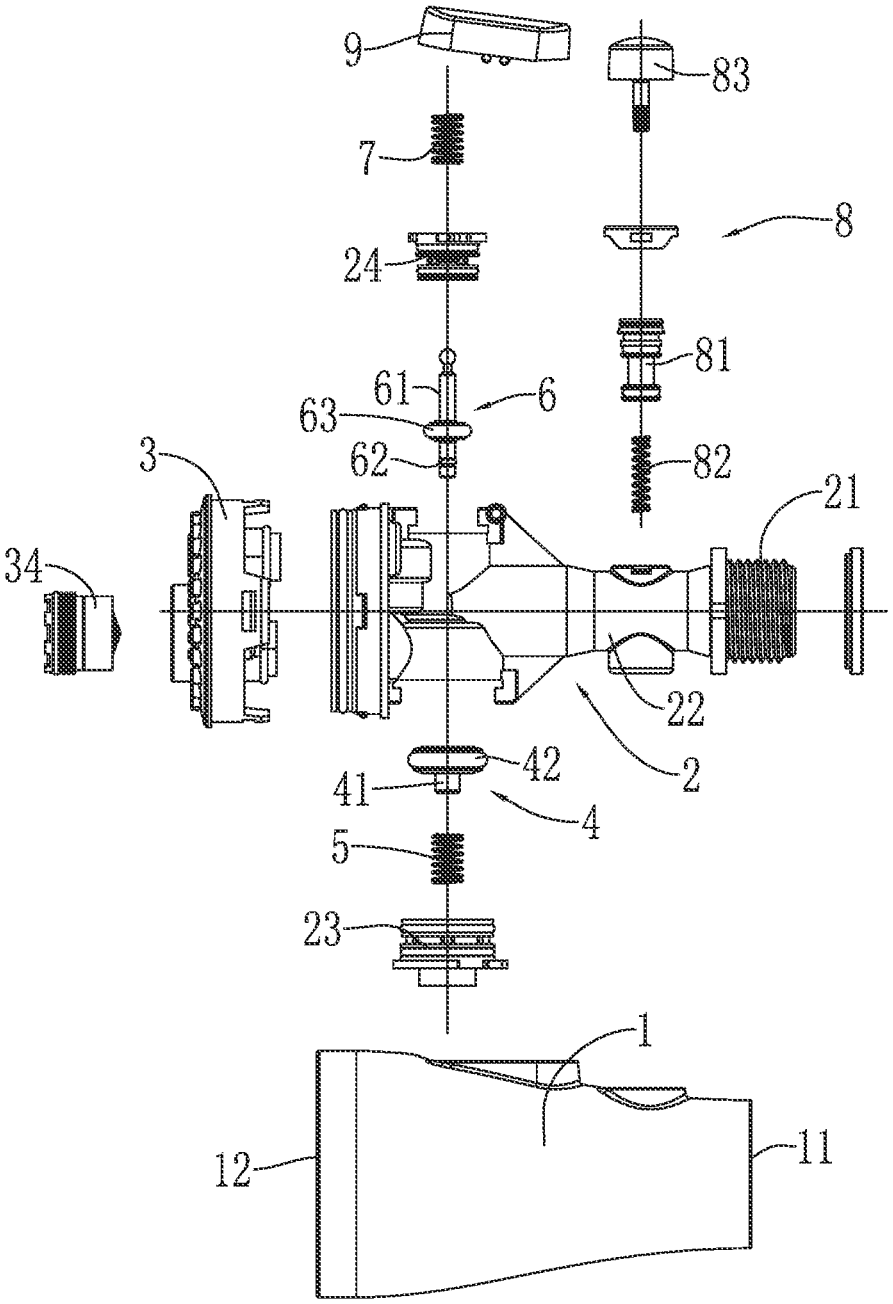
FIG. 2 illustrates an exploded view of the water outlet device in the embodiment.

The present disclosure will be further described below in combination with the accompanying drawings and embodiments.

Some directional terms used to describe the drawings, such as "inner", "outer", "above", "below", and other directional terms will be understood to have their normal meaning and refer to those directions involved in normal viewing of the drawings. Unless otherwise indicated, directional terms described herein substantially follow conventional directions as understood by those skilled in the art.

The terms "first", "second", "third", and similar terms used in the present disclosure do not denote any order, quantity, or importance in the present disclosure, but are used to distinguish one component from other components.

Referring to FIGS. 1 to 6, a water outlet device 100 is provided and comprises a housing 1 and a water diversion body 2 disposed in the housing 1. The housing 1 has a revolving structure in a hollow penetrating shape. A diameter of the housing 1 gradually increases from a first side opening 11 of the housing 1 to a second side opening 12 of the housing 1. One end of the water diversion body 2 defines an inlet connector 21 extending out of the first side opening 11, and an outer wall of the inlet connector 21 comprises an external thread structure.

The water outlet device 100 further comprises a water outlet panel 3 disposed on the second side opening 12 of the housing 1 and connected to the water diversion body 2. The water outlet panel 3 comprises a first water outlet port 31, a second water outlet port 32, and a third water outlet port 33. The first water outlet port 31 is disposed with an aerator 34 to discharge aerated water, the second water outlet port 32 comprises a plurality of fine jet openings to discharge fine jet water, and the first water outlet port 31 is spaced apart from the second water outlet port 32. The third water outlet port 33 comprises a plurality of water outlet holes discharging a shower water and surrounding the first water outlet port 31 and the second water outlet port 32.

The water diversion body 2 comprises an inlet passage 221, a first outlet passage 222, a second outlet passage 223, a third outlet passage 224, a first valve chamber 225, and a second valve chamber 226, which are defined and extend in the water diversion body 2. The inlet passage 221 is located adjacent to the first side opening 11 of the housing 1, and the inlet passage 221 extends through the inlet connector 21. The first outlet passage 222, the second outlet passage 223, and the third outlet passage 224 are located adjacent to the second side opening 12 of the housing 1. The first outlet passage 222 is in communication with the first water outlet port 31, the second outlet passage 223 is in communication with the second water outlet port 32, and the third outlet passage 224 is in communication with the third water outlet port 33. The inlet passage 221 and the first outlet passage 222 are each in communication with the first valve chamber 225. The second outlet passage 223 and the third outlet passage 224 are each in communication with the second valve chamber 226, and the first valve chamber 225 is in communication with the second valve chamber 226.

In this embodiment, the first valve chamber 225 is coaxial with the second valve chamber 226. The water outlet device 100 comprises a first sealing member 4 and a second sealing member 6, and the first sealing member 4 is coaxial with the second sealing member 6 to achieve a more stable switching and linkage. The first sealing member 4 is movably disposed in the first valve chamber 225 to be controlled to alternatively block the second valve chamber 226 or the first outlet passage 222. The second sealing member 6 is movably disposed in the second valve chamber 226 to be controlled to alternatively block the second outlet passage 223 or the third outlet passage 224. When the second sealing member 6 is controlled to move and to be changed from blocking the second outlet passage 223 to blocking the third outlet passage 224, the first sealing member 4 is correspondingly changed from blocking the second valve chamber 226 to blocking the first outlet passage 222, and the first sealing member 4 continues blocking the first outlet passage 222 due to water pressure.

The water outlet device 100 further comprises a first resetting member 5. When the inlet passage 221 is blocked so as to be changed from a water supply state to a water stop state, the first sealing member 4 is biased by the first resetting member 5 to move to block the second valve chamber 226.

When the water outlet device 100 is in use, a user can operate the first sealing member 4 to achieve turning ON and OFF of water flowing through the first water outlet port 31, the second water outlet port 32, and the third water outlet port 33. When the water outlet device 100 is not supplied with water, the first sealing member 4 is biased by the first resetting member 5 to move to block the second valve chamber 226, and the second sealing member 6 correspondingly blocks the second outlet passage 223. At this time, when the water outlet device 100 is supplied with water, the water flows sequentially through the inlet passage 221, the first valve chamber 225, and the first outlet passage 222 to be discharged from the first water outlet port 31.

The user can operate the second sealing member 6 to move and to be changed from blocking the second outlet passage 223 to blocking the third outlet passage 224, the first sealing member 4 is correspondingly changed from blocking the second valve chamber 226 to blocking the first outlet passage 222, and the water flows sequentially through the first valve chamber 225, the second valve chamber 226, and the second outlet passage 223 to be discharged from the second water outlet port 32. At this time, the first sealing member 4 continues blocking the first outlet passage 222 due to water pressure. The user can also operate the second sealing member 6 to move to block the third outlet passage 224, and the water flows sequentially through the first valve chamber 225, the second valve chamber 226, and the third outlet passage 224 to be discharged from the third water outlet port 33.

In this embodiment, a divided passage 227 is connected between the first valve chamber 225 and the second valve chamber 226, and the first sealing member 4 blocks the divided passage 227 to achieve blocking of the second valve chamber 226.

In this embodiment, the water outlet device 100 further comprises a second resetting member 7. When the water outlet device 100 is not supplied with water, the first sealing member 4 is biased by the first resetting member 5 to move to block the second valve chamber 226, and the second sealing member 6 is operatively coupled to the first sealing member 4 and is biased by the second resetting member 7 to block the second outlet passage 223, which defines a more stable switching due to the second sealing member 6 being simultaneously pushed by the first sealing member 4 and the second resetting member 7. The water outlet device 100 initially resets to an initial state in which the water outlet device 100 is not supplied with water. Upon being supplied with water again, the water still flows out of the first water outlet port 31 first, and the water still sequentially flows out of the second water outlet port 32 and the third water outlet port 33 due to the second sealing member 6 being controlled. In this embodiment, the first resetting member 5 and the second resetting member 7 are springs.

In this embodiment, the second sealing member 6 continues alternatively blocking the second outlet passage 223 or the third outlet passage 224 due to water pressure. When the user alternatively controls the second outlet passage 223 or the third outlet passage 224 to be in communication with water (i.e., to receive water), the user does not need to continuously apply force to the second sealing member 6 to maintain a constant water outlet state.

In this embodiment, the water outlet device 100 comprises a water stopping member 8. The water stopping member 8 is controlled to block the inlet passage 221. Specifically, the inlet passage 221 comprises a water stopping chamber 2211 connecting an inlet portion of the inlet passage 221 and an outlet portion of the inlet passage 221. The water stopping member 8 comprises a water stopping piston 81, a water stopping spring 82, and a water stopping button 83. The water stopping piston 81 moves along an axial direction of the water stopping chamber 2211 to alternatively block or not block the inlet passage 221. The water stopping spring 82 is connected between the water stopping piston 81 and the water stopping chamber 2211, and the water stopping button 83 is connected to the water stopping piston 81 and exposed out of the housing 1. When the user applies an external force to the water stopping button 83 (i.e., pushes the water stopping button 83), the water stopping piston 81 correspondingly moves to block the inlet passage 221, and the water stopping spring 82 is biased to generate a resetting force. When the user is not applying the external force to the water stopping button 83, the water stopping piston 81 moves to enable the inlet passage 221 to be opened due to the resetting force of the water stopping spring 82.

The second sealing member 6 comprises a switching valve shaft 61, and the switching valve shaft 61 is controlled to slide and extend into the first valve chamber 225 to push the first sealing member 4. A sliding shaft hole 228 extends and is connected between the first valve chamber 225 and the second valve chamber 226, and an axis of the sliding shaft hole 228 coincides with that of the switching valve shaft 61. A first end of the switching valve shaft 61 passes through the sliding shaft hole 228 and then extends into the first valve chamber 225. The second sealing member 6 further comprises a sealing ring 62 that is sealingly connected between the sliding shaft hole 228 and the switching valve shaft 61, and the sealing ring 62 can prevent water from flowing from the sliding shaft hole 228 to the second valve chamber 226.

The second sealing member 6 further comprises a second sealing gasket 63 disposed on the switching valve shaft 61, and the second sealing gasket 63 moves with the switching valve shaft 61 to alternatively block the second outlet passage 223 or the third outlet passage 224. The second sealing gasket 63 is made of a flexible material, such as rubber, silica gel, and the like.

The water diversion body 2 comprises a diversion main body 22, a first valve lid 23, and a second valve lid 24. The inlet passage 221, the first outlet passage 222, the second outlet passage 223, and the third outlet passage 224 are defined in the diversion main body 22. The first valve lid 23 is connected to the diversion main body 22 to define the first valve chamber 225, and the second valve lid 24 is connected to the diversion main body 22 to define the second valve chamber 226. During an installation process, the first sealing member 4 and the second sealing member 6 are initially installed in the diversion main body 22. The first valve lid 23 and the second valve lid 24 are then respectively connected to the diversion main body 22, which can prevent the first sealing member 4 and the second sealing member 6 from being too large to be respectively installed in the first valve chamber 225 and the second valve chamber 226.

The first sealing member 4 comprises a sealing seat 41 and a first sealing gasket 42 disposed on the sealing seat 41. The switching valve shaft 61 pushes the sealing seat 41 to drive the first sealing gasket 42 to block the first outlet passage 222. The first sealing gasket 42 is made of a flexible material, such as rubber, silica gel, and the like. The first valve lid 23 comprises a guiding valve shaft 231 on which the sealing seat 41 slides, and the guiding valve shaft 231 performs a guiding function for the sealing seat 41. In this embodiment, the first resetting member 5 is connected between the first valve lid 23 and the sealing seat 41. An axis of the guiding valve shaft 231 coincides with that of the switching valve shaft 61. The sealing seat 41 comprises an interacting plane 411. When the water outlet device 100 is not in communication with water (i.e., the water outlet device 100 is not receiving water), the interacting plane 411 abuts the sliding shaft hole 228 due to the sealing seat 41 being pushed by the first resetting member 5, the first sealing gasket 42 blocks the second valve chamber 226, and the switching valve shaft 61 slides and abuts the interacting plane 411 to drive the sealing seat 41 to slide on the guiding valve shaft 231.

The water outlet device 100 further comprises a switching button 9 operatively coupled to the switching valve shaft 61 and configured to drive the switching valve shaft 61 to slide. The switching button 9 is rotatably connected to a second end of the switching valve shaft 61, and the switching button 9 swings and drives the switching valve shaft 61 to slide. The second resetting member 7 is connected between the second valve lid 24 and the switching button 9. The switching button 9 comprises a first switching side 91 disposed adjacent to the switching valve shaft 61 and a second switching side 92 disposed away from the switching valve shaft 61, and the switching button 9 is swingingly connected to the diversion main body 22.

Figure 3:
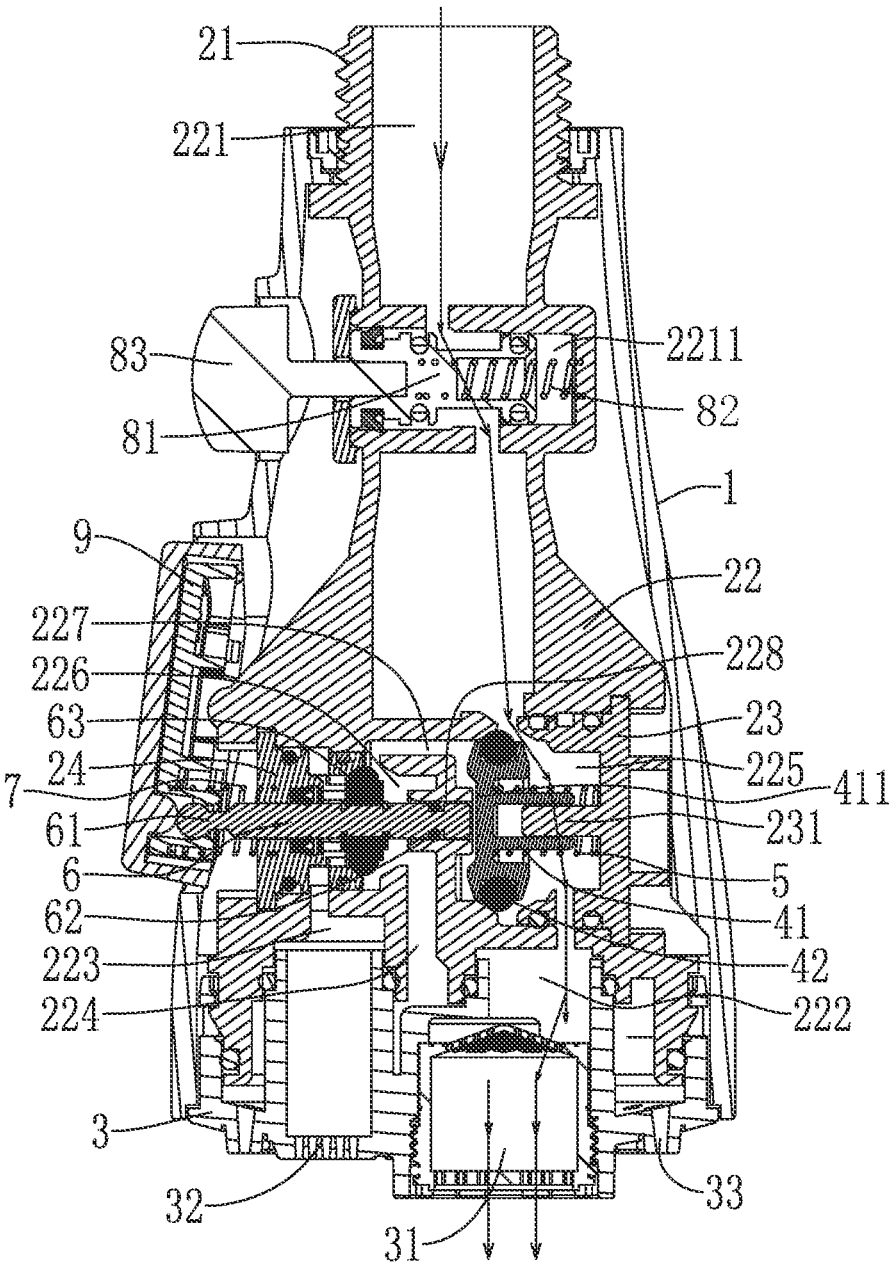
FIG. 3 illustrates a cross-sectional view of the water outlet device in the embodiment when the water outlet device is in an initial state and water flows out of a first outlet passage.

Referring to FIG. 3, the water outlet device 100 is in the initial state. The first sealing gasket 42 disposed on the sealing seat 41 blocks the second valve chamber 226 due to the first resetting member 5, and the second sealing gasket 63 blocks the second outlet passage 223 due to the switching valve shaft 61 being pushed by the second resetting member 7. At this time, the water flows sequentially through the inlet connector 21, the inlet passage 221, the first valve chamber 225, and the first outlet passage 222 to be discharged from the first water outlet port 31.

Figure 4:
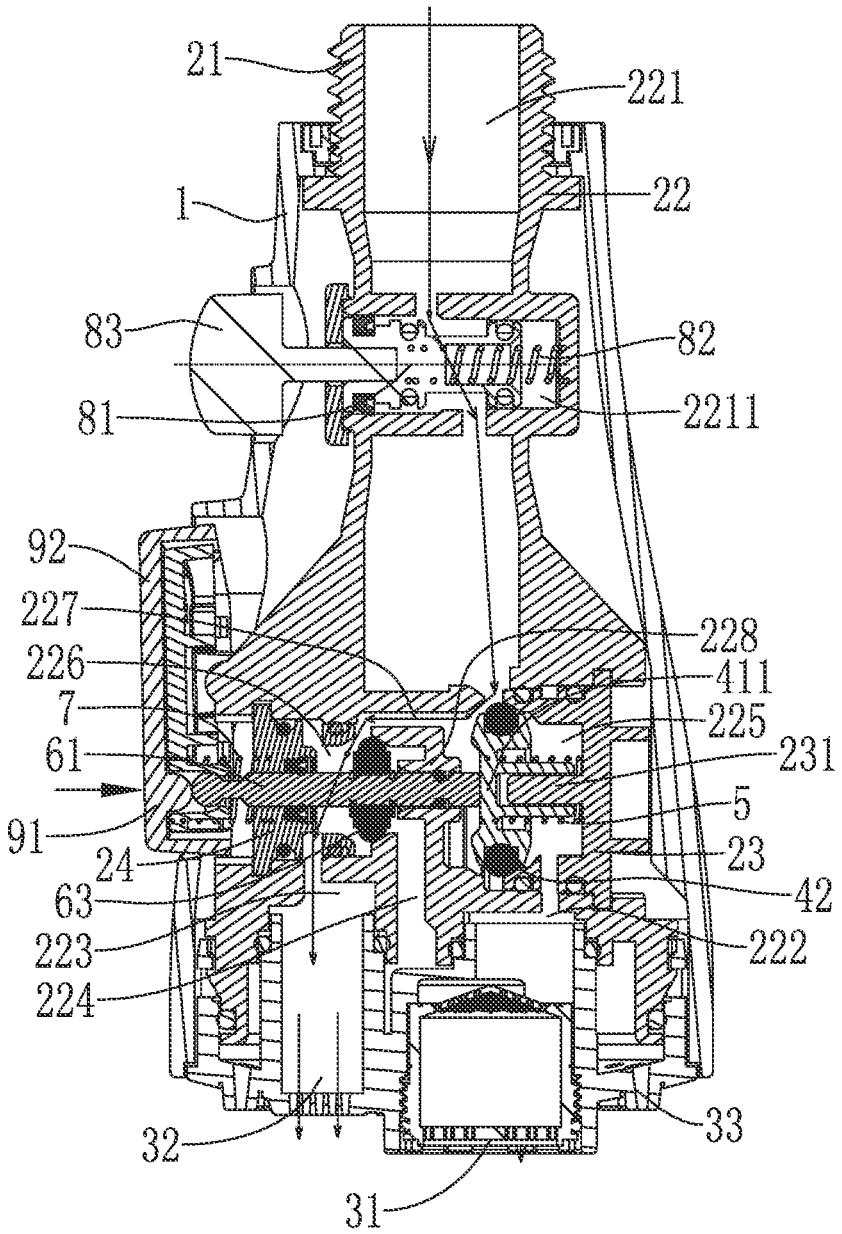
FIG. 4 illustrates a cross-sectional view of the water outlet device in the embodiment when a second sealing member is controlled to drive a first sealing member to block the first outlet passage and the water flows out of a second outlet passage.

Referring to FIG. 4, an external force is applied to the first switching side 91 when the water outlet device 100 is in the initial state, and the switching valve shaft 61 slides and drives the second sealing gasket 63 to be changed from blocking the second outlet passage 223 to blocking the third outlet passage 224. The switching valve shaft 61 slides and enables the first end of the switching valve shaft 61 to pass through the sliding shaft hole 228 and extend into the first valve chamber 225 until the first end of the switching valve shaft 61 abuts the interacting plane 411. At this time, the sealing seat 41 slides on the guiding valve shaft 231 due to being pushed by the switching valve shaft 61 until the first sealing gasket 42 is changed from blocking the second valve chamber 226 to blocking the first outlet passage 222, and the first sealing gasket 42 continues blocking the first outlet passage 222 due to water pressure. At this time, the first valve chamber 225 is in communication with the second valve chamber 226 through the divided passage 227, and the water flows sequentially through the inlet passage 221, the first valve chamber 225, the divided passage 227, the second valve chamber 226, and the second outlet passage 223 to be discharged from the second water outlet port 32. At this time, the second sealing gasket 63 continues blocking the third outlet passage 224 due to water pressure, and the user does not need to apply the external force to the first switching side 91.

Figure 5:
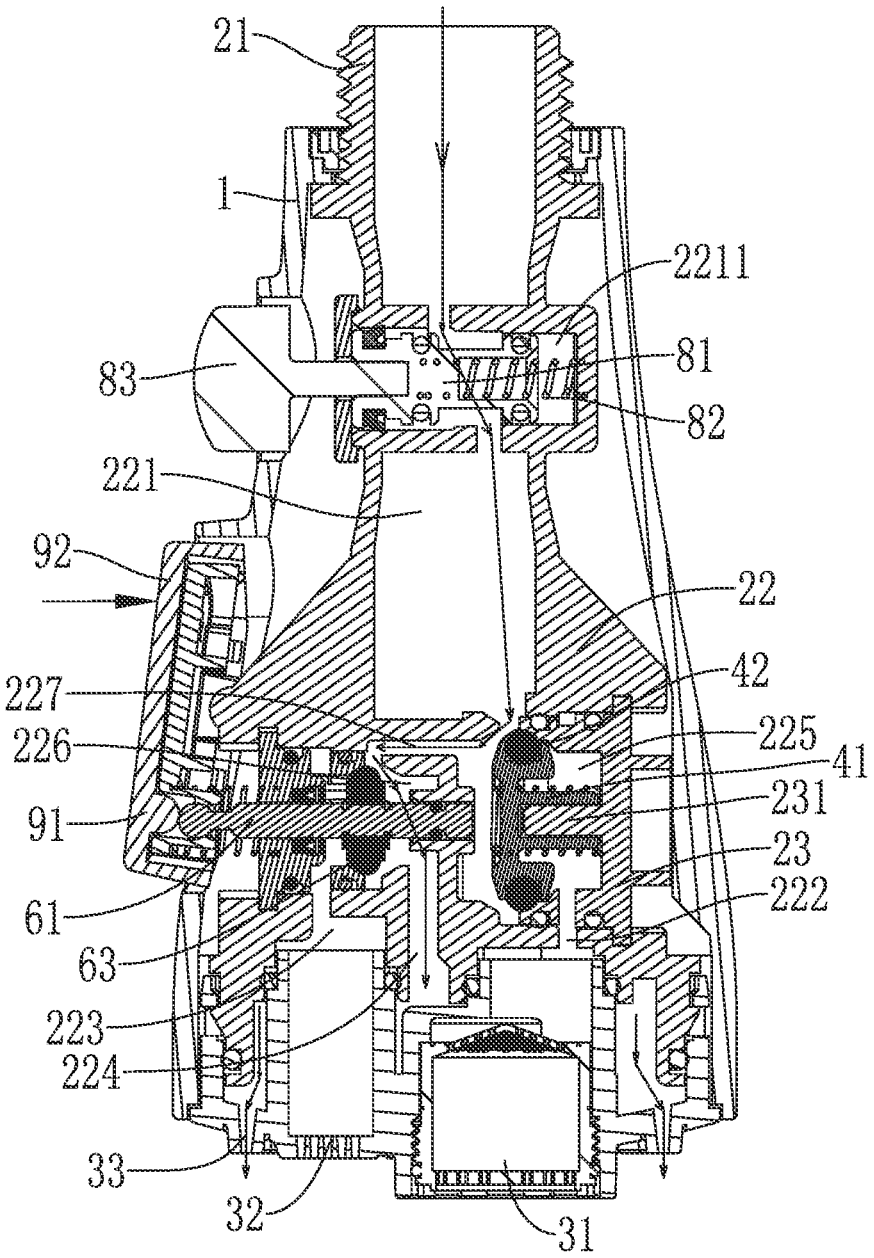
FIG. 5 illustrates a cross-sectional view of the water outlet device in the embodiment when the first sealing member blocks the first outlet passage, the second sealing member is changed to block the second outlet passage, and the water flows out of a third outlet passage.

Referring to FIG. 5, an external force is applied to the second switching side 92 when the water outlet device 100 is in a state which is shown in FIG. 4. At this time, the switching button 9 swings and drives the switching valve shaft 61 to move, the second sealing gasket 63 moves with the switching valve shaft 61 to be changed from blocking the third outlet passage 224 to blocking the second outlet passage 223, and the water flows sequentially through the inlet passage 221, the first valve chamber 225, the divided passage 227, the second valve chamber 226, and the third outlet passage 224 to be discharged from the third water outlet port 33. The user can alternatively control the second water outlet port 32 or the third water outlet port 33 to be in communication with the water (i.e., to receive the water) through the switching button 9. At this time, the second sealing gasket 63 continues blocking the second outlet passage 223 due to water pressure, and the user does not need to apply the external force to the second switching side 92.

Figure 6:
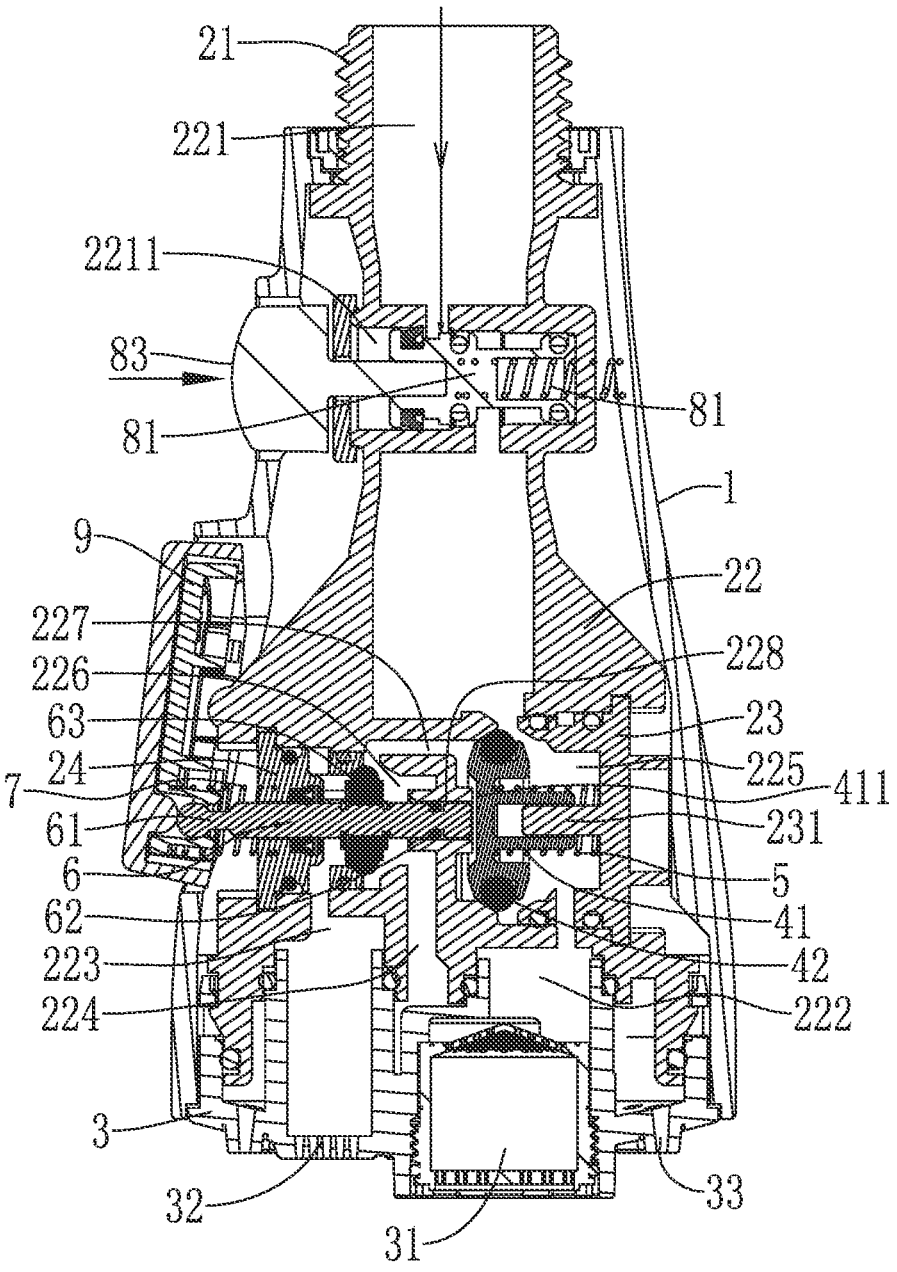
FIG. 6 illustrates a cross-sectional view of the water outlet device in the embodiment when a water stopping member blocks an inlet passage and the water outlet device is reset to be in the initial state.

Referring to FIG. 6, the water stopping button 83 is pushed by the user for a long time when the water outlet device 100 is in a state which is shown in FIG. 4 or FIG. 5. At this time, the inlet passage 221 is blocked to be changed from the water supply state to the water stop state, the first sealing member 4 is biased to move to block the second valve chamber 226, and the second sealing member 6 is biased to move to block the second outlet passage 223 due to being pushed by the first sealing member 4 and the second resetting member 7, and the water outlet device 100 resets to be in the initial state. When the user releases the water stopping button 83, the water flows out of the first water outlet port 31.

The present disclosure has been described with reference to the preferred embodiments, and it is understood that the embodiments are not intended to limit the scope of the present disclosure. Moreover, as the contents disclosed herein should be readily understood and can be implemented by a person skilled in the art, all equivalent changes or modifications which do not depart from the concept of the present disclosure should be encompassed by the appended claims.

What is claimed is:

1. A water outlet device, comprising:

an inlet passage, a first outlet passage, a second outlet passage, a third outlet passage, a first valve chamber, a second valve chamber, a first sealing member, a second sealing member, and a first resetting member, wherein:

the inlet passage and the first outlet passage are each in communication with the first valve chamber, the second outlet passage and the third outlet passage are each in communication with the second valve chamber, the first valve chamber is in communication with the second valve chamber, the first sealing member is movably disposed in the first valve chamber to be controlled to alternatively block the second valve chamber or the first outlet passage, the second sealing member is movably disposed in the second valve chamber to be controlled to alternatively block the second outlet passage or the third outlet passage, and when the second sealing member is controlled to move and to be changed from blocking the second outlet passage to blocking the third outlet passage:

the first sealing member is correspondingly changed from blocking the second valve chamber to blocking the first outlet passage, and the first sealing member continues blocking the first outlet passage due to water pressure, and when the inlet passage is changed from a water supply state to a water stop state:

the first sealing member is biased by the first resetting member to move to block the second valve chamber.

2. The water outlet device according claim 1, wherein:
when the first sealing member is biased by the first resetting member to move to block the second valve chamber, the second sealing member correspondingly blocks the second outlet passage.

3. The water outlet device according claim 2, comprising:
a second resetting member, wherein when the inlet passage is blocked:
the second sealing member is biased by the second resetting member to block the second outlet passage.

4. The water outlet device according claim 2, wherein:
the second sealing member comprises a switching valve shaft, and
the switching valve shaft is controlled to slide and extend into the first valve chamber to push the first sealing member.

5. The water outlet device according claim 4, wherein:
a sliding shaft hole extends and is connected between the first valve chamber and the second valve chamber,
a first end of the switching valve shaft passes through the sliding shaft hole and then extends into the first valve chamber,
the second sealing member further comprises a sealing ring, and
the sealing ring is sealingly connected between the sliding shaft hole and the switching valve shaft.

6. The water outlet device according claim 4, wherein:
the second sealing member further comprises a second sealing gasket disposed on the switching valve shaft, and
the second sealing gasket moves with the switching valve shaft to alternatively block the second outlet passage or the third outlet passage.

7. The water outlet device according claim 1, comprising:
a second resetting member, wherein:
when the inlet passage is changed from the water supply state to the water stop state, the second sealing member is biased by the second resetting member to block the second outlet passage.

8. The water outlet device according claim 1, wherein:
when the inlet passage is in the water supply state, the second sealing member continues alternatively blocking the second outlet passage or the third outlet passage due to the water pressure.

9. The water outlet device according claim 8, wherein:
the second sealing member comprises a switching valve shaft, and
the switching valve shaft is controlled to slide and extend into the first valve chamber to push the first sealing member.

10. The water outlet device according claim 9, wherein:
a sliding shaft hole extends and is connected between the first valve chamber and the second valve chamber,
a first end of the switching valve shaft passes through the sliding shaft hole and then extends into the first valve chamber,
the second sealing member further comprises a sealing ring, and
the sealing ring is sealingly connected between the sliding shaft hole and the switching valve shaft.

11. The water outlet device according claim 1, wherein:
the first sealing member is coaxial with second sealing member.

12. The water outlet device according claim 1, comprising:
a water stopping member, wherein the water stopping member is controlled to block the inlet passage.

13. The water outlet device according claim 12, wherein:
a sliding shaft hole extends and is connected between the first valve chamber and the second valve chamber,
a first end of the switching valve shaft passes through the sliding shaft hole and then extends into the first valve chamber,
the second sealing member further comprises a sealing ring, and
the sealing ring is sealingly connected between the sliding shaft hole and the switching valve shaft.

14. The water outlet device according claim 11, wherein:
the second sealing member comprises a switching valve shaft, and
the switching valve shaft is controlled to slide and extend into the first valve chamber to push the first sealing member.

15. The water outlet device according claim 1, wherein:
the second sealing member comprises a switching valve shaft, and
the switching valve shaft is controlled to slide and extend into the first valve chamber to push the first sealing member.

16. The water outlet device according claim 15, wherein:
a sliding shaft hole extends and is connected between the first valve chamber and the second valve chamber,
a first end of the switching valve shaft passes through the sliding shaft hole and then extends into the first valve chamber,
the second sealing member further comprises a sealing ring, and
the sealing ring is sealingly connected between the sliding shaft hole and the switching valve shaft.

17. The water outlet device according claim 15, wherein:
the second sealing member further comprises a second sealing gasket disposed on the switching valve shaft, and
the second sealing gasket moves with the switching valve shaft to alternatively block the second outlet passage or the third outlet passage.

18. The water outlet device according claim 15, comprising:
a switching button, wherein the switching button is operatively coupled to the switching valve shaft and configured to drive the switching valve shaft to slide.

19. The water outlet device according claim 12, wherein:
the second sealing member comprises a switching valve shaft, and
the switching valve shaft is controlled to slide and extend into the first valve chamber to push the first sealing member.

20. The water outlet device according claim 19, wherein:
a sliding shaft hole extends and is connected between the first valve chamber and the second valve chamber,
a first end of the switching valve shaft passes through the sliding shaft hole and then extends into the first valve chamber,
the second sealing member further comprises a sealing ring, and
the sealing ring is sealingly connected between the sliding shaft hole and the switching valve shaft.

* * * * *